US005164026A

United States Patent [19]

Muller

[11] Patent Number: 5,164,026

[45] Date of Patent: Nov. 17, 1992

[54] COLORING A GOLD ALLOY

[75] Inventor: Ludwig Muller, Celigny, Switzerland

[73] Assignee: Ludwig Muller S.A., Switzerland

[21] Appl. No.: 724,755

[22] Filed: Jul. 2, 1991

Related U.S. Application Data

[62] Division of Ser. No. 510,168, Apr. 17, 1990, Pat. No. 5,059,255.

[30] Foreign Application Priority Data

Jun. 27, 1989 [CH] Switzerland ..... 2402/89

[51] Int. Cl.[5] ..... C22C 5/02; C21D 1/44

[52] U.S. Cl. ..... 148/430; 420/512

[58] Field of Search ..... 148/430; 420/512

[56] References Cited

U.S. PATENT DOCUMENTS

| | | | |
|---|---|---|---|
| 660,983 | 10/1900 | Conner et al. | 148/125 |
| 1,580,443 | 4/1926 | Shields | 420/512 |
| 2,576,738 | 11/1951 | Williams | 420/481 |
| 4,820,487 | 4/1989 | Antoniazzi | 420/512 |

FOREIGN PATENT DOCUMENTS

| | | | |
|---|---|---|---|
| 896114 | 11/1953 | Fed. Rep. of Germany . | |
| 1442528 | 5/1966 | France . | |
| 49-48813 | 12/1974 | Japan | 420/512 |
| 57-5833 | 1/1982 | Japan . | |
| 2184457 | 6/1987 | United Kingdom . | |

*Primary Examiner*—R. Dean
*Assistant Examiner*—Robert R. Koehler
*Attorney, Agent, or Firm*—Ostrolenk, Faber, Gerb & Soffen

[57] ABSTRACT

A gold alloy comprises at least gold, iron and nickel, the gold being present in an amount between about 74.4 and 94.5 percent by weight of the alloy, the iron being present in an amount between about 5.0 and 25.0 percent by weight of the alloy, and the nickel being present in an amount between about 0.5 to about 0.6 percent by weight of the alloy. Heat treatment of the alloy causes a visually observable blue coloration.

9 Claims, No Drawings

COLORING A GOLD ALLOY

This is a division of application Ser. No. 07/510,168, filed Apr. 17, 1990 now U.S. Pat. No. 5,059,255.

BACKGROUND OF THE INVENTION

The present invention relates to gold alloys and, more particularly, to certain nickel/iron alloys of gold which, when heated as described herein, may display a visually observable increase in blue coloration.

In order to manufacture jewels and articles of gold, certain aesthetically desirable effects may be imparted to gold jewelry or other articles by using gold alloys having different colorations which make it possible to obtain a decorative effect.

For this purpose, one can use alloys having one component which confers a predominant color on the item. For instance, copper may be added to gold to produce a red-gold alloy, or palladium may be added in order to produce a grayish-gold alloy. Alternatively, desired coloration of the metal surface can be obtained, for example, by electrodeposition or by heat treatment.

German application DE-3641 228 Al discloses an alloy of gold, chromium, molybdenum, vanadium, carbon, tungsten and iron. The alloy presents an iridescent blue coloration after brief treatment with a flame.

SUMMARY OF THE INVENTION

An object of the present invention is to provide gold alloys having desirable aesthetic coloration by methods which are both economical and efficient.

Another object of the invention is to provide a pre-alloy suitable for intermixing with substantially pure gold to provide gold alloys capable of displaying desired coloration.

Another object of the invention is to provide methods for the blue coloration of gold alloys in an efficient and economical manner.

The above and other objects are achieved by providing the gold alloys, pre-alloys, gold-containing objects and preparation methods set forth herein. In one aspect, the present invention provides a gold alloy comprising at least gold, iron and nickel, and particularly an alloy comprising gold in the range of from 74.4 to 94.5 percent by weight of the alloy, iron in the range of from 5.0 to 25.0 percent by weight of the alloy, and nickel in the range of from 0.5 to 0.6 percent by weight of the alloy.

The present invention also provides a method of preparing alloys of gold or gold-containing objects having desired color characteristics which method comprises the steps of melting at least gold, iron and nickel, to form an alloy consisting essentially of gold, iron and nickel, said gold being present at a concentration between about 74.4 and 94.5 percent by weight, said iron being present at a concentration between about 5.0 and about 25.0 percent by weight, sand said nickel being present at a concentration between about 0.5 and about 0.6 percent by weight; forming said object by pouring said alloy into a mold in the shape of a said object; heating said object at a temperature between 450° C. and 600° C. until a visually observable increase in blue color occurs; and cooling said object to ambient temperature.

In preferred embodiments, nickel is present at a concentration of 0.6%, and gold is present at a concentration which varies from 75% to 85% and iron makes up the remainder of the alloy. For example, preferred gold- /iron/nickel percentages may be 85/14.4/0.6 respectively, or 75/24.4/0.6.

DESCRIPTION OF PREFERRED EMBODIMENTS

A gold alloy in accordance with the invention is characterized by the presence of at least the following elements in the weight percentages (by weight of alloy) shown below:

Gold: 74.4 to 94.5 percent
Iron: 5.0 to 25.0 percent
Nickel: 0.5 to 0.6 percent

Especially preferred concentrations are gold in the range of from about 75.0 to about 85.0 percent, iron in the range of from about 14.4 to about 24.4 percent and nickel in the range of from about 0.5 to about 0.6 percent. An alternative formulation may comprise from about 75 to about 80 percent gold, from about 20 to 25 percent iron and from about 0.5 to 0.6 percent nickel.

In one preferred embodiment, a 20 karat alloy contains 85 percent (by weight of alloy) gold, 14.4 percent iron and 0.6 percent nickel. In another preferred embodiment, an 18 karat alloy contains 75 percent (by weight of alloy) of gold, 24.4 percent iron and 0.6 percent of nickel.

The invention also extends to a method of treating the gold alloys of the invention or objects of gold made therefrom wherein the alloy or object of gold is heated (e.g. in a furnace) at a predetermined temperature, preferably under a normal atmosphere, for a predetermined period of time, and then cooled to ambient temperature after emergence from the furnace so as to obtain surface blueing. Without intending to be bound by theory, it is believed that blueing is the result of oxidation of the non-precious elements contained in the alloy.

The temperature of the furnace is preferably from 450° to 600° C. and the duration of the heat treatment is preferably about 10–12 minutes, depending upon the size of the piece being heated. The duration of the heat treatment is longer for large pieces (watch cases or jewels, for instance) than for small pieces (elements of rings, bracelets or clips). Furthermore, the duration of the heat treatment depends on the temperature of the furnace and is shorter when the temperature of the furnace is higher. At a furnace temperature of 500° C., for example, a preferred duration of heat treatment for a 10 gram ring is about 10 minutes; for a 30 gram brooch, about 12 minutes.

The blueing of an object made with the first alloy of 20 karats is more pronounced than that of an object made with the second alloy of 18 karats, which verges on greenish-blue.

An alloy may be obtained by intermixing a pre-alloy with substantially pure gold. The ratio of iron to nickel in either the pre-alloy or the final alloy is preferably from about 50:1–25:3. Beginning with a pre-alloy of this ratio, pure gold may be added to bring the total gold content to the preferred 74.4 to 94.5% range, and will necessarily leave the nickel and iron percentages in their preferred ranges (0.5–0.6% and 5.0–25.0%, respectively). For example, if one melts 80 percent of fine gold of 24 karats with 20 percent of a pre-alloy in order to obtain a final alloy of 85 percent gold, 14.4 percent iron and 0.6 percent nickel. The pre-alloy may contain:

Gold: 25 percent
Iron: 72 percent
Nickel: 3 percent

To generalize, if the weight of the prealloy is X percent of the final alloy obtained by mixing with (100−×) percent of substantially pure 24 karat gold, then a final alloy of, for example, 85 percent gold, 14.4 percent iron and 0.6 percent nickel may be obtained using a pre-alloy comprising (x≧15)):

| | | |
|---|---|---|
| Gold: | [(85 − (100 − X)] (100/X) | percent |
| Iron: | (14.4) (100/X) | percent |
| Nickel: | (0.6) (200/X) | percent |

More generally, where the final alloy is prepared, by intermixing only (100−×) percent of 24 karat gold and X percent of a pre-alloy, the pre-alloy is preferably comprised of gold, iron and nickel in the concentrations given by the following formulas (in weight percent of pre-alloy):

Gold: [(74.4 to 94.5)-(100−×)](100/×) percent

Iron: (5 to 25) (100/×) percent

Nickel: (0.5 to 0.6) (100/×) percent

The usual melting point of the final alloy

Jewelry parts comprising the alloy of the invention may be assembled by brazing, using conventional brazing alloys with the usual additions in order to obtain a range of hard solders which can be used at decreasing temperatures starting from a temperature about 100° below the melting point of the alloy.

The terms and descriptions used herein are preferred embodiments set forth by way of illustration only, and are not intended as limitations on the many variations which those of skill in the art will recognize to be possible in practicing the present invention as defined by the following claims.

What is claimed is:

1. A gold alloy consisting essentially of gold, iron and nickel, said gold being present at a concentration between about 74.4 and 94.5 percent by weight of the alloy, said iron being present at a concentration between about 5.0 and about 25.0 percent by weight of the alloy, and said nickel being present at a concentration between about 0.5 and about 0.6 percent by weight of the alloy.

2. The gold alloy of claim 1 wherein said alloy comprises about 85.0 percent gold, about 14.4 percent iron and about 0.6 percent nickel.

3. The gold alloy of claim 1 wherein said alloy comprises about 75.0 percent gold, about 24.4 percent iron and about 0.6 percent nickel.

4. The gold alloy of claim 1 wherein said alloy comprises from 75 to 85 percent gold, from 14.4 to 25.6 percent iron and from 0.5 to 0.6 percent nickel.

5. The alloy of claim 1 wherein, said alloy has been heated at a temperature and for a time sufficient to enable said alloy to undergo a color change observable with the naked eye.

6. The alloy of claim 2 wherein, said alloy has been heated at a temperature and for a time sufficient to enable said alloy to undergo a color change observable with the naked eye.

7. The alloy of claim 3 wherein, said alloy has been heated at a temperature and for a time sufficient to enable said alloy to undergo a color change observable with the naked eye.

8. The gold alloy of claim 6, wherein said color change is indicated by an observable increase in blue color, wherein said heating occurs in a furnace under a normal atmosphere, and wherein said alloy is cooled to ambient temperature after it is removed from the furnace.

9. An aesthetic jewelry item comprising the alloy of claim 1.

* * * * *